US006200424B1

(12) United States Patent
Saari et al.

(10) Patent No.: US 6,200,424 B1
(45) Date of Patent: Mar. 13, 2001

(54) METHOD AND ARRANGEMENT FOR CALENDERING A BOARD WEB

(75) Inventors: Juhani Saari, Tampere; Stefan Kuni, Järvenpää , both of (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 08/895,195

(22) Filed: Jul. 16, 1997

(30) Foreign Application Priority Data

Jul. 16, 1996 (FI) ..... 960404

(51) Int. Cl.[7] ..... D21F 11/00

(52) U.S. Cl. ..... 162/205; 162/206; 162/207; 162/360.2; 162/360.3; 162/361; 427/211; 427/361; 427/364; 427/365; 427/366; 427/428; 100/38; 100/43; 100/73

(58) Field of Search ..... 162/205, 206, 162/207, 360.2, 360.3, 361; 427/211, 361, 364, 365, 366, 428; 100/38, 43, 73

(56) References Cited

U.S. PATENT DOCUMENTS 5,378,497 * 1/1995 Johnson et al. ..... 427/211

OTHER PUBLICATIONS

Jukka Lehtinen, "The Heat Pipe Process in Intraweb Heat Transfer in Hot–Surface Paper Drying" Paper and Timber, vol. 74, No. 7, 1992.

* cited by examiner

*Primary Examiner*—Stanley S Silverman
*Assistant Examiner*—Mark Halpern
(74) *Attorney, Agent, or Firm*—Steinberg & Raskin, P.C.

(57) ABSTRACT

An arrangement and method for calendering a board web including a calender providing a hot and hard calendering nip formed by two calender rolls and through which the board web passes. At least one of the calender rolls is arranged to be heated to such a temperature that the surface layer of the board web placed at the side of this roll reaches its vitrification temperature in the calendering nip. A film press is arranged directly before the calendering nip in the direction of transfer of the board web and includes a film press nip through which the board web is passed. The film press nip is arranged to transfer a liquid layer onto the face of the board web so as to moisten the board web. The board web is transferred from the film press nip into the calendering nip while the surface layer of the web is at the moisture level determined by the film press in view of producing a controlled moisture gradient.

20 Claims, 4 Drawing Sheets

METHOD AND ARRANGEMENT FOR CALENDERING A BOARD WEB

FIELD OF THE INVENTION

The present invention relates to an arrangement for calendering a board web which comprises a calender which includes a hot and hard calendering nip formed by means of two calender rolls and through which the board web passes. In the calender, at least one of the calender rolls is arranged to be heated to such a temperature that the surface layer of the board web placed at the side of this roll reaches its vitrification temperature in the calendering nip.

BACKGROUND OF THE INVENTION

Generally, calendering of a board is understood as pressing of a board web in a nip formed by two rolls. The diameters and hardnesses of the rolls that form the nip can be either equal or different. The primary function of the calendering of a board is to equalize the thickness profile of the board and to improve the smoothness of the board by pressing the board web against the face of a smooth roll, in which connection, plastic deformations take place in the face of the board web and the roll face is reproduced in the face of the board. Since the compression pressure produced by means of a calendering nip is limited and the time of dwell of the board web in the nip is very short, just of an order of a few milliseconds, the calendering effect is typically intensified by means of a hot calender nip.

A board web is composed of wood fiber, which is a plastic material consisting of various organic polymers, such as amorphous lignin and hemicellulose and partly of crystalline cellulose. When the temperature and the moisture content become higher, the plasticizing temperatures of the fibers become lower.

In calendering, compression of the board web also always occurs, as a result of which the density of the board is increased, i.e., its bulk is lowered, and the rigidity of the board is reduced. In the case of package board, one of the most important pairs of properties are exactly its bulk and rigidity. Package board must be as thick and rigid as possible in relation to its weight. For this reason, calendering of board must be carried out by calendering methods that provide economies in respect of bulk. As a calender for board web, increased use has been made of soft calenders both with coated consumer package grades and also with other board grades. In soft calenders, attempts are made to take advantage of the higher calendering temperature and an extended nip in order to improve the deformability in the calendering of board. For example, attempts are made to abandon Yankee cylinders completely by replacing them with soft calenders. Also, owing to some of their inferior properties, attempts are made to abandon so-called wet-stack calenders, which have been used for calendering of board, by replacing them with soft calenders.

It is an ordinary arrangement in a production line, which comprises surface sizing and/or coating and calendering of a board web, that the board web is first passed, for example, through a film size press, and after that the board web is dried in a dryer group which comprises a number of drying cylinders. After the drying unit placed after the film size press, calendering of the board web is carried out, usually by means of a so-called wet-stack calender. A wet-stack is used primarily because in the preceding drying unit, the board web has been dried to an excessive dryness, in which case it must be moistened in the calender to the desired water content. In a wet-stack calender, water is added to the face of the board either by means of a mist jet before the first nip or by means of a water doctor arranged in connection with one or more of the calender rolls. By means of the water, exclusively the surface layer of the board web is moistened, in which case it is possible to achieve good smoothness without compressing the board so that it becomes excessively thin. A wet-stack calender commonly consists of a number of rolls that are arranged as a stack of rolls whereby adjacent rolls form a nip with one another.

After the calendering, the board web is dried again, because the amount of water that was added to the board web in the wet-stack calender does not evaporate from it to a sufficient extent during calendering, in which connection, after calendering, the drying is again carried out in a dryer group which comprises a number of drying cylinders. After this second drying, the board web is finally passed through a machine stack. From the above, it may be appreciated that the conventional arrangement requires a large amount of space in the machine direction, because surface sizing has required drying equipment of its own, and calendering in the wet-stack calender has required its own drying equipment. It has been desirable to avoid using such an abundant requirement of space for a calender.

In view of producing an adequate moisture gradient, in a number of board machines, a steam box is installed additionally in front of the calender in order to moisten the surface layer of the board web. In moistening by means of a steam box, the high temperature of the web is a considerable problem, for this temperature ought to be lowered to a level considerably below about 70° C. in order that a sufficiently large amount of steam may condense in the face of the board web. This again requires cooling of the web, which again causes further problems because of the requirement of space and the dripping and problems of rust arising from the cooling cylinders. Cooling of the web by other means, except by means of cylinders, is economically unprofitable and technically difficult.

So far, it has not yet been fully possible to provide a solution in which a wet-stack calender could be replaced completely by means of a soft calender. Attempts have also been made to develop a soft calender in the direction towards gradient calendering. The materials of a soft roll have been developed so as to endure higher temperatures, and the nip temperature has been raised constantly, and the development seems to be moving further towards ever higher temperatures. These very high temperatures produce difficulties of their own in calendering.

OBJECTS AND SUMMARY OF THE INVENTION

It is an object of the present invention to provide a novel arrangement and method which meet the requirements described above and imposed in the art on calendering of board.

It is another object of the present invention to provide a new calendering arrangement and method which provide a significant improvement in comparison with the present-day equipment and processes for surface-sizing/coating and calendering.

In view of achieving these objects and others, the arrangement in accordance with the invention comprises a film press arranged directly before the calendering nip in the direction of transfer of the board web, the film press comprising a film press nip through which the board web is passed and in which a liquid layer is transferred onto the face of the board web so as to moisten the board web. The board web is transferred from the film press nip into the calendering nip while the surface layer of the web is at the moisture level determined by the film press in view of producing a controlled moisture gradient.

By means of the present invention, significant advantages are obtained compared with the prior art apparatus and methods, and one of these significant advantages is that the requirement of space for the apparatus is substantially smaller than in the prior art. Thus, the arrangement requires a considerably shorter space in the machine direction than in the prior art. Compared with earlier constructions, it is a further substantial advantage that the cost of the arrangement is lower than in the prior art, because it has been possible to omit one of the drying units completely. From the point of view of the process itself, the arrangement in accordance with the invention is simpler and easier to control.

One embodiment of the arrangement for calendering a board web in accordance with the invention includes a film press arranged directly before the calendering nip in a running direction of the board web and comprising a film press nip through which the board web passes, and first moistening means for transferring a liquid onto the first side of the board web in the film press nip to form a liquid layer on the first side of the board web. The board web is transferred from the film press nip into the calendering nip, the first side of the web contacting a first, heated calender roll, such that the surface layer of the web on the first side of the board web is at the moisture level determined by the film press to produce a controlled moisture gradient. If the second calender roll is also heated to a temperature such that a surface layer on a second side of the board web contacting the second calender roll reaches its vitrification temperature in the calendering nip, then the film press may include second moistening means for transferring a liquid onto the second side of the board web in the film press nip to form a liquid layer thereon.

In an exemplifying embodiment, the film press nip is defined by a pair of film press rolls, the web passing between the first and second film press rolls, and the moistening means comprise application means for applying the liquid onto a face of the respective film press roll such that the liquid is carried thereon to be transferred onto the respective side of the board web in the film press nip. The moistening means are structured and arranged to transfer water onto the side(s) of the web, starch surface size onto the side(s) of the board web such that the board web is surface-sized and moistened simultaneously, a liquid containing protein or a chemical that has properties similar to protein onto the side(s) of the board web, a liquid containing a pigment onto the side(s) of the board web in order to improve the micro-smoothness of the surface layer thereon, and/or a coating agent containing a pigment onto the side(s) of the board web in order to moisten the board web and form a coating layer thereon.

The method for calendering a board web in accordance with the invention comprises the steps of passing the board web through a film press nip, transferring a liquid onto a first side of the board web in the film press nip to form a liquid layer on the first side of the board web, transferring the board web from the film press nip into a calendering nip arranged directly after the film press nip in a running direction of the board web, i.e., without intervening web processing stages which directly contact the web and/or affect the web's properties, the calendering nip being defined by first and second calender rolls such that the first side of the board web contacts the first calender roll, and heating the first calender roll to a temperature such that a surface layer of the first side of the board web reaches its vitrification temperature. In a more specific embodiment, a liquid is also transferred onto a second side of the board web in the film press nip to form a liquid layer thereon, this second side of the board web contacting the second calender roll which is then also heated to a temperature such that a surface layer of the second side of the board web reaches its vitrification temperature. With respect to one manner for transferring the liquid onto the board web, the film press nip may be formed from first and second film press rolls whereby the liquid transferring step(s) comprise applying the liquid onto a face of the film press roll(s) and carrying the liquid thereon to be transferred onto the respective side of the board web in the film press nip. The web may be heated between the film press nip and the calendering nip by means of a heating device without contact between a component of the heating device and the web, and the web may be dried after the calendering nip.

Other advantages and characteristic features of the invention will come out from the following detailed description of the invention.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
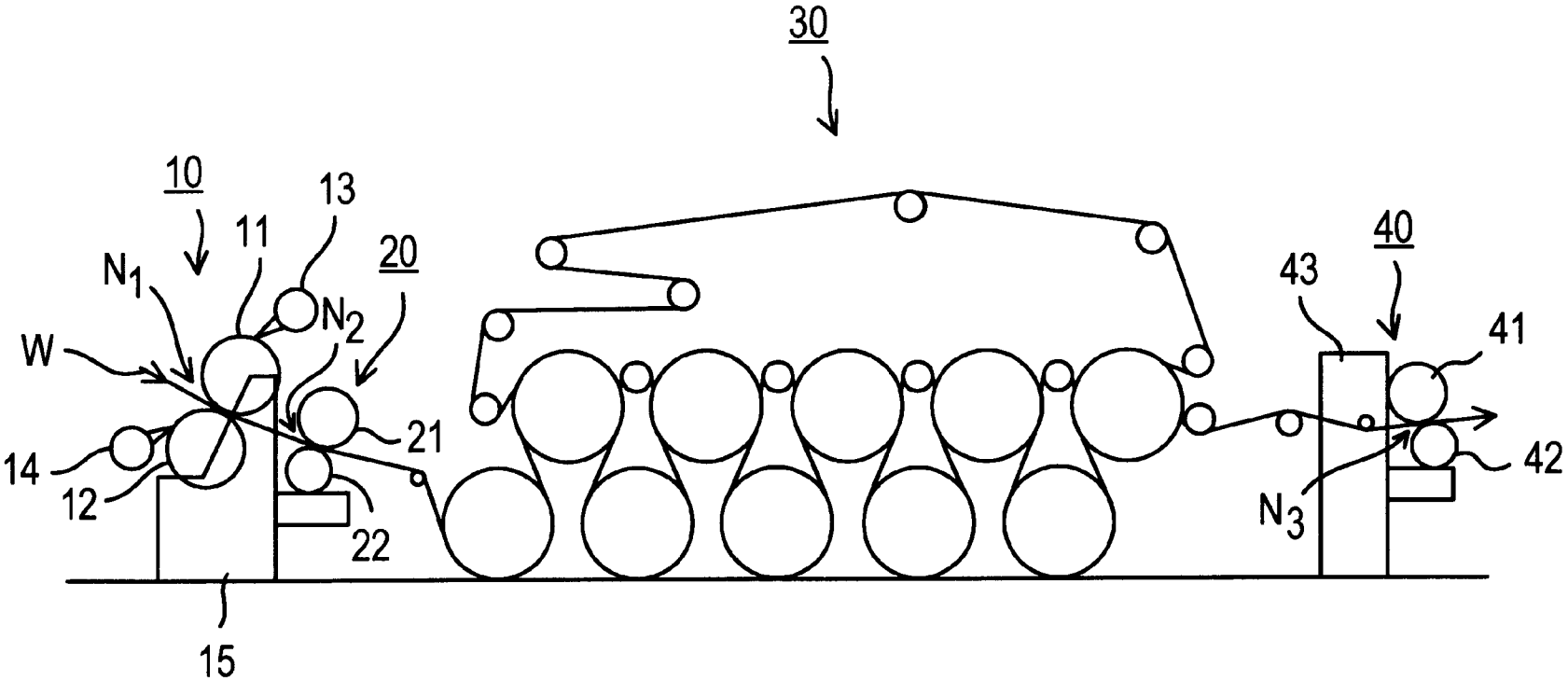
FIG. 1 shows an embodiment in which the surface-sizing/moistening and the calendering are carried out in one and the same unit in accordance with the invention.

Referring to the accompanying drawings wherein like reference numerals refer to the same or similar elements, in the arrangement shown in FIG. 1, a board web W is passed into a nip $N_1$ of a film size press 10 and thereafter directly into a hard-nip hot calender 20 including a calendering nip $N_2$, i.e., without any intervening web processing equipment. After calendering, the board web is dried by passing the web W from the calendering nip $N_2$ through a drying group 30 into a machine stack 40. The film size press 10 comprises film press rolls 11,12 which are provided with applicator means 13,14, respectively, by whose means a liquid such as water, starch surface size or equivalent, or a pigment-containing coating agent is spread as a film onto the faces of the size press rolls 11,12 so that this agent is transferred in the film size press nip $N_1$ onto the face of the board web W. The frame of the film size press 10 is denoted by reference numeral 15, and in the embodiment shown in FIG. 1 the first hot hard-nip calender 20 in the equipment in accordance with the invention is placed directly after the film size press 10 so that calender rolls 21,22 that form the calendering nip $N_2$ of the calender 20 are mounted on the same frame with the film press rolls 11,12. Thus, in this arrangement, the board web W is transferred from the film press nip $N_1$ directly into the first calendering nip $N_2$ without any intermediate stage.

By means of application of the liquid, such as water, onto the board web W directly before the hot calendering nip, a controlled moisture gradient is obtained. In the film size press 10 that employs the film transfer technique, a uniform liquid layer of a magnitude of about 5 to about 40 grams per square meter is transferred under control in the film press 11 nip $N_1$ onto the face of the board web W. Such a liquid amount is absorbed in the board web W into a depth of about 40 to about 45 grams per square meter, i.e., right through the surface or rear layer, but, however, not through the whole board web W, which is the case when conventional vat size presses are used.

In the film size press 10, water alone or starch surface size can be applied to the board web W, in which connection the surface sizing of the web W is carried out in the same process. In view of the vitrification temperature of the surface layer of the board web W, the application of starch can be preferable, because the vitrification temperature of starch is lower than the vitrification temperature of cellulosic fibers. In the film size press 10, some other chemical, besides starch, can also be applied to the board web W, such as, for example, a protein or equivalent, which has been used earlier, for example, in the prior art wet-stack calenders. In the equipment in accordance with the present invention, it is also possible to apply a pigment onto the board web W or to apply a coating layer proper in the film size press 10. It has been noticed that an addition of a few grams of pigment before the first calender 20 improves the microsmoothness and the appearance of the surface layer of the board web W.

As stated above, the board web W is not intentionally dried after the film size press 10 and before it enters into the first calendering nip $N_2$. In such a case, the surface layer of the board web W is wet and more readily deformable in the directly-following, hot calendering nip $N_2$. The transfer of heat in the hot calendering nip $N_2$ into the wet board web W is considerably more efficient than the transfer of heat into a dry web. The arrangement in accordance with the invention is in particular intended for calendering the board web W in connection with the first calendering nip $N_2$ before coating of the board web W irrespective of the board grade. As explained earlier, after the first calendering nip $N_2$, the board web W is dried in the dryer group 30 comprising drying cylinders, after which the board web W is passed in the normal way into the machine stack 40, which comprises calender rolls 41,42 mounted on a frame 43 of the machine stack and forming a calendering nip $N_3$ between them. After the machine stack 40, the calendered board web W can be passed into the coating process proper.

Figure 2:
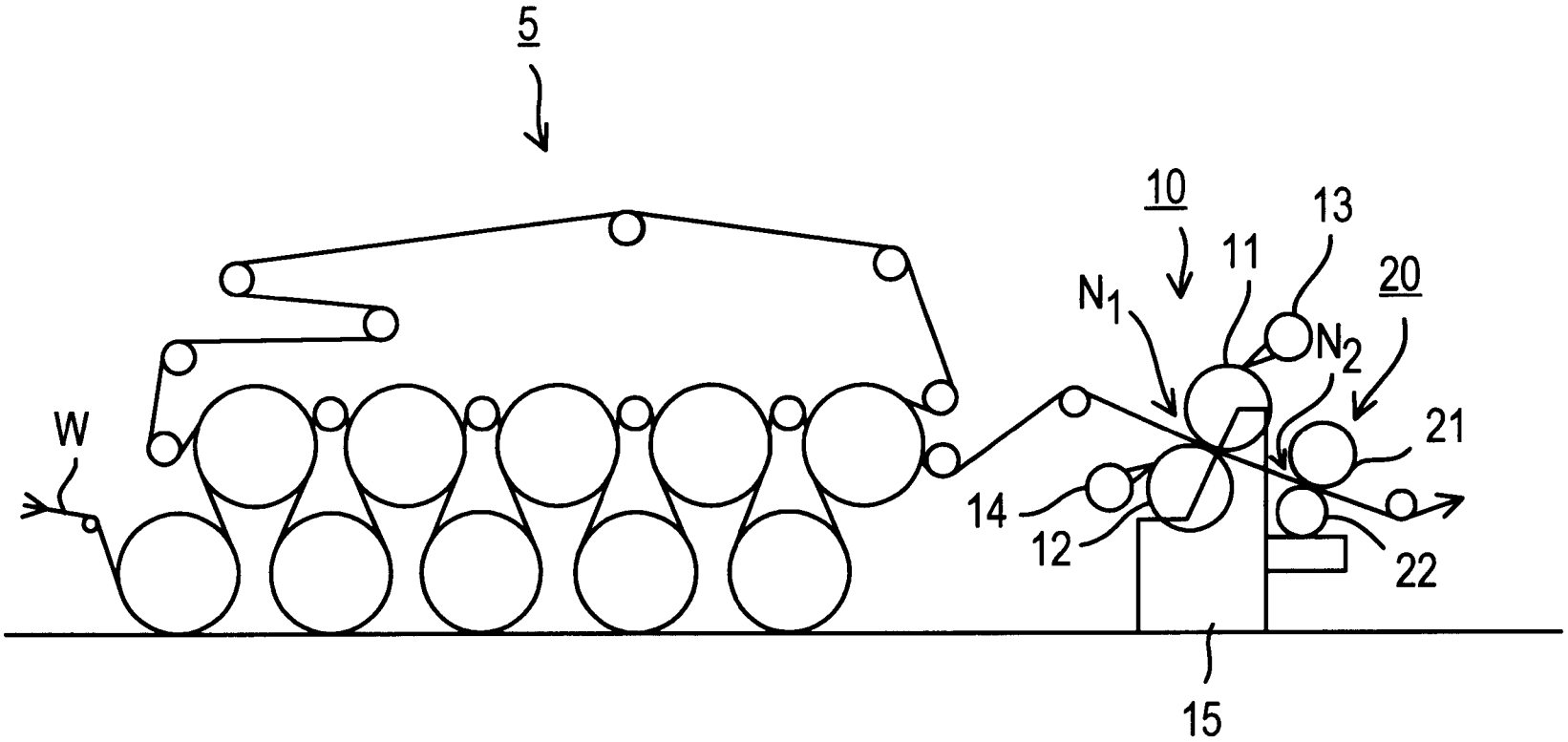
FIG. 2 shows an embodiment in which the surface-sizing/moistening and the calendering are carried out in one and the same unit without after-drying in accordance with the invention.

The construction shown in FIG. 2 differs from that shown in FIG. 1 in the respect that, after moistening and calendering, the board web W is no longer after-dried, but the board web W can be passed, after calendering, for example, directly into a coating process proper. Thus, in the arrangement shown in FIG. 2, the web W is passed from a forward dryer group 5, e.g., of the dryer section of the paper machine, into the film press nip $N_1$ formed between the film press rolls 11,12. In the embodiment of FIG. 2, the film size press 10 is similar to that described in relation to FIG. 1, so that the film press rolls 11,12 are provided with applicator means 13,14, respectively, by whose means water or some other liquid is applied as a film onto the faces of the film press rolls 11,12 so that the water/liquid is transferred in the film press nip $N_1$ under control and to the desired extent onto the face of the board web W. Directly after the film size press 10, a hot hard-nip calender 20 is mounted in a manner similar to the embodiment shown in FIG. 1. In this respect, the construction of FIG. 2 is identical with that shown in FIG. 1, so that the board web W is passed from the film press nip $N_1$ directly into the calendering nip $N_2$ without any intermediate stage and so that the calender rolls 21,22 are mounted on the same frame 15 with the film press rolls 11,12.

Figure 3:
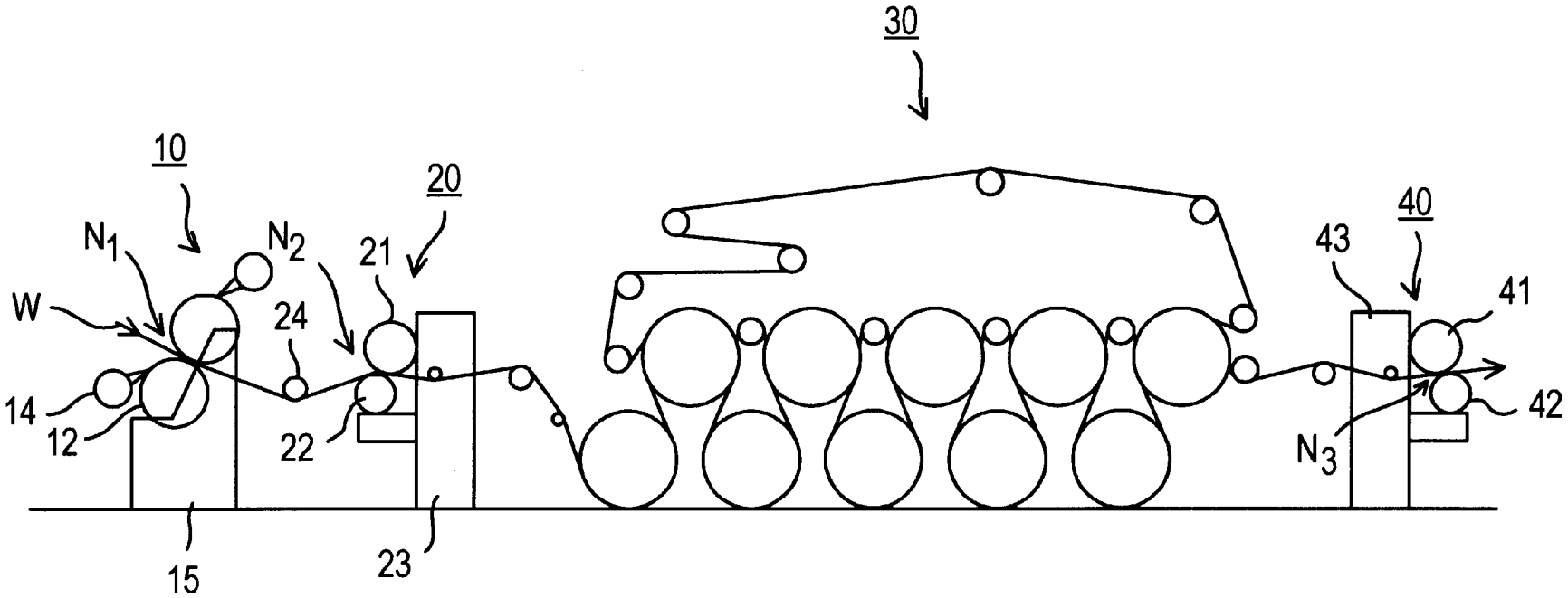
FIG. 3 shows an embodiment in which the surface-sizing/moistening and the calendering are carried out one after the other in separate units in accordance with the invention.

The construction shown in FIG. 3 is to a large extent similar to and identical with the embodiment shown in FIG. 1 and described above. In respect of its construction, the embodiment of FIG. 3 differs from that shown in FIG. 1 exclusively in the respect that, in the construction of FIG. 3, the calendering rolls 21,22 of the first hot, hard-nip calender 20 following after the film size press 10 have been mounted on a frame 23 of their own and not on the same frame 15 with the film size press 10. Thus, in the embodiment of FIG. 3, the board web W is brought from the film press $N_1$ into the first calendering nip $N_2$ guided by a guide and turning roll 24. In respect of the treatment of the web, between the film press nip $N_1$ and the first calendering nip $N_2$, nothing is done to the web W, so that as a process the embodiment of FIG. 3 is identical with FIG. 1. From the first calendering nip $N_2$, the board web W is passed into the after-dryer group 30 and from it further into the calendering nip $N_3$ of the machine stack 40. In these respects, reference is made fully to the description given in relation to FIG. 1.

Figure 4:
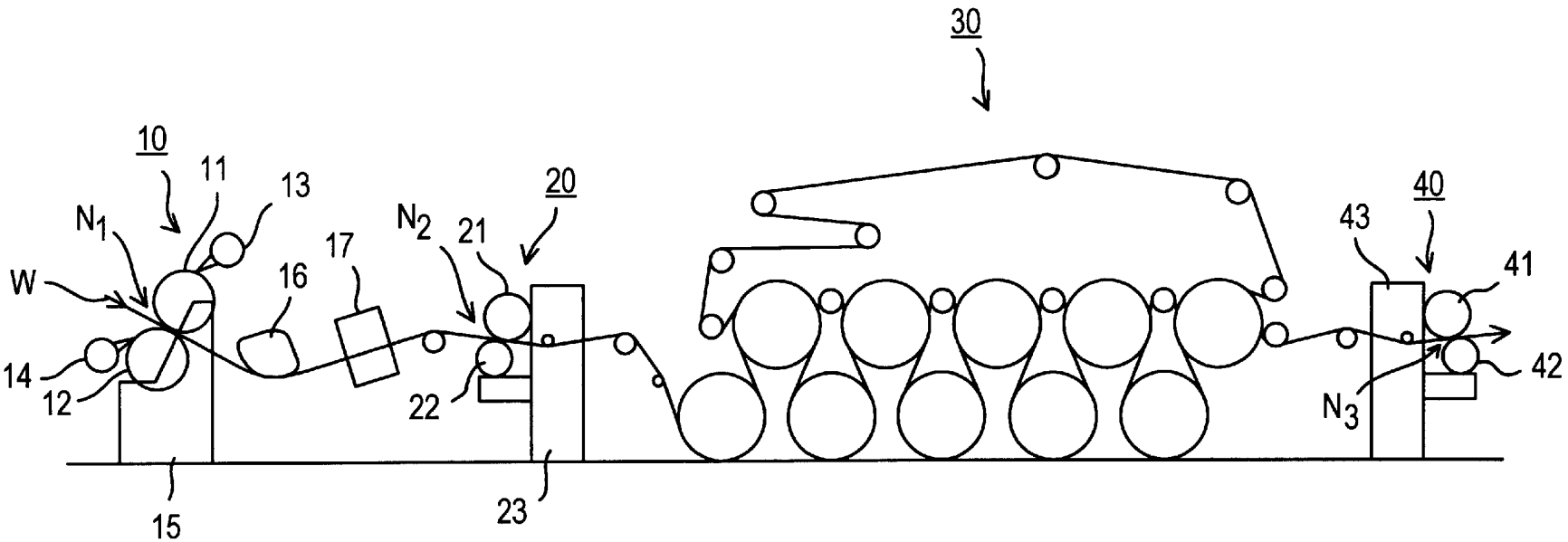
FIG. 4 shows an embodiment in which the surface-sizing/moistening and the calendering are carried out one after the other in separate units and in which the calender is provided with pre-heating in accordance with the invention.

The embodiment shown in FIG. 4 differs from the construction of FIG. 3 in the respect that the board web W is pre-heated before it enters from the film press nip $N_1$ into the first hot and hard calendering nip $N_2$. Thus, in the embodiment of FIG. 4, the moistened board web W coming from the film press nip $N_1$ is passed through an air turning device 16 free from contact with the web and into a pre-heater 17 and only from there into the first hot calendering nip $N_2$. The pre-heater 17 is a heater that does not contact the web W, preferably an infrared heater. Thus, in the embodiment of FIG. 4, the web W is first moistened in the film press nip $N_1$ and after that pre-heated by means of the pre-heater 17, in which connection the web W can be made to enter into the hot calendering nip $N_2$ when hot and moistened. By means of this arrangement, it has been possible to lower the vitrification temperature of the surface layer of the web W further. In all other respects, the embodiment shown in FIG. 4 is similar to the construction illustrated in FIG. 3, so that in this respect reference is made to the description given above.

With regard to the foundation of the constructions in accordance with the present invention, the following should be stated. One of the most important component factors from the point of view of thermal conductivity of board are the molecular thermal conductivities of the solid materials and the substances present in the pores in the board. The thermal conductivity of board is improved when the density of the board is increased, for example, as a result of grinding, wet compression and calendering. A sufficiently high temperature and moisture in the fibrous layer have a considerable effect on internal transfer of heat in the web by means of the vaporization/condensing process of water. Water present on a hot face vaporizes and moves towards a colder face until the temperature of the web is lower than the vaporization temperature of water. According to studies that have been carried out, the vaporization/condensing process is highly efficient when the temperature of a board web exceeds about 100° C. In such a case, the transfer of heat takes place very rapidly by means of the so-called heat pipe effect. In respect of the mechanism of the heat pipe effect, reference is made to the paper by Jukka Lehtinen, "The heat pipe process in intra-web heat transfer in hot-surface paper drying" in the publication Paperi ja Puu—Paper and Timber, vol. 74, No. 7, 1992, pages 560–571. The speed of transfer of steam in a calendering nip is affected substantially by whether the steam must be diffused through a layer of air or if the steam can pass without diffusion in the interior of a board web. When the cold face of a web is closed, the steam is partly diffused through a layer of air, in which case the efficiency of the transfer of heat is about 2–3 times higher than conduction of heat taking place along fiber faces. A heat pipe effect can be produced in the web by evacuating the air from the web, for example by means of steam or application of water, before the board web enters into contact with a hot calender nip. In such a case, the transfer of heat in a short nip is about 10 times more efficient than in conduction of heat taking place along the fiber faces in a fully dry web. When the web has an open cold face and when the temperature of the hot side of a wet web is higher than about 100° C., no significant difference has been noticed in the internal transfer of heat in the web irrespective of whether the web contained air or steam. This comes from the fact that the steam displaces the air contained in the web, which air is removed through the open cold face.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. In an arrangement for calendering a board web including a calender comprising first and second calender rolls arranged to form a calendering nip through which the board web passes, at least said first calender roll being heated to a temperature such that a surface layer on a first side of the board web contacting said first calender roll reaches its vitrification temperature in the calendering nip, the improvement comprising:

a film press arranged directly before the calendering nip in a running direction of the board web, said film press comprising a film press nip through which the board web passes, and first moistening means for transferring a liquid onto said first side of the board web in said film press nip to form a liquid layer on said first side of the board web, and wherein the board web is transferred from said film press nip into the calendering nip such that the surface layer of the web on said first side of the board web is at the moisture level determined by said film press to produce a controlled moisture gradient.

2. The arrangement of claim 1, wherein said second calender roll is heated to a temperature such that a surface layer on a second side of the board web contacting said second calender roll reaches its vitrification temperature in the calendering nip, said film press further comprising second moistening means for transferring a liquid onto said second side of the board web in said film press nip to form a liquid layer on said second side of the board web, the board web being transferred from said film press nip into the calendering nip such that the surface layer of the web on said second side of the board web is at the moisture level determined by said film press to produce a controlled moisture gradient.

3. The arrangement of claim 1, wherein said film press nip is defined by first and second film press rolls, the web passing between said first and second film press rolls, said first moistening means comprising application means for applying the liquid onto a face of said first film press roll such that the liquid is carried on said face of said first film press roll to be transferred onto said first side of the board web in said film press nip.

4. The arrangement of claim 2, wherein said film press nip is defined by first and second film press rolls, the web passing between said first and second film press rolls, said first moistening means comprising first application means for applying the liquid onto a face of said first film press roll such that the liquid is carried on said face of said first film press roll to be transferred onto said first side of the board web in said film press nip, said second moistening means comprising application means for applying the liquid onto a face of said second film press roll such that the liquid is carried on said face of said second film press roll to be transferred onto said second side of the board web in said film press nip.

5. The arrangement of claim 1, wherein said first moistening means are structured and arranged to transfer water onto said first side of the web.

6. The arrangement of claim 1, wherein said film press constitutes a size press and said first moistening means are structured and arranged to transfer starch surface size onto said first side of the board web such that the board web is surface-sized and moistened simultaneously.

7. The arrangement of claim 1, wherein said first moistening means are structured and arranged to transfer a liquid containing protein or a chemical that has properties similar to protein onto said first side of the board web.

8. The arrangement of claim 1, wherein said first moistening means are structured and arranged to transfer a liquid containing a pigment onto said first side of the board web in order to improve the micro-smoothness of the surface layer on said first side of the board web.

9. The arrangement of claim 1, wherein said first moistening means are structured and arranged to transfer a coating agent containing a pigment onto said first side of the board web in order to moisten the board web and form a coating layer on said first side of the board web.

10. The arrangement of claim 1, wherein said first moistening means are structured and arranged to transfer an amount of the liquid onto said first side of the board web in a range of from about 5 to about 40 grams per square meter.

11. The arrangement of claim 1, further comprising a heating device arranged between said film press nip and the calendering nip for heating the web without contact between a component of said heating device and the web.

12. The arrangement of claim 11, wherein said heating device is selected from a group consisting of a contact-free heater and an infrared heater.

13. The arrangement of claim 1, further comprising drying means arranged after the calendering nip for drying the board web.

14. The arrangement of claim 11, wherein said drying means comprise an after-dryer group including a plurality of drying cylinders, further comprising a machine stack arranged after said after-dryer group for calendering the board web.

15. A method for calendering a board web, comprising the steps of:

passing the board web through a film press nip, transferring a liquid onto a first side of the board web in said film press nip to form a liquid layer on said first side of the board web, transferring the board web from said film press nip into a calendering nip arranged directly after said film press nip in a running direction of the board web, said calendering nip being defined by first and second calender rolls such that said first side of the board web contacts said first calender roll, and heating said first calender roll to a temperature such that a surface layer of said first side of the board web reaches its vitrification temperature.

16. The method of claim 15, further comprising the steps of:

transferring a liquid onto a second side of the board web in said film press nip to form a liquid layer on said second side of the board web, said second side of the board web contacting said second calender roll, and heating said second calender roll to a temperature such that a surface layer of said second side of the board web reaches its vitrification temperature.

17. The method of claim 15, further comprising the step of:

forming said film press nip from first and second film press rolls, said liquid transferring step comprising the steps of applying the liquid onto a face of said first film press roll and carrying the liquid on said face of said first film press roll to be transferred onto said first side of the board web in said film press nip.

18. The method of claim 16, further comprising the step of:

forming said film press nip from first and second film press rolls, said step of transferring the liquid onto said first side of the board web comprising the steps of applying the liquid onto a face of said first film press roll and carrying the liquid on said face of said first film press roll to be transferred onto said first side of the board web in said film press nip, said step of transferring the liquid onto said second side of the board web comprising the steps of applying the liquid onto a face of said second film press roll and carrying the liquid on said face of said second film press roll to be transferred onto said second side of the board web in said film press nip.

19. The method of claim 15, further comprising the step of heating the web between said film press nip and the calendering nip by means of a heating device without contact between a component of said heating device and the web.

20. The method of claim 15, further comprising the step of drying the board web after the calendering nip.

* * * * *